US005253937A

United States Patent [19]

Scheimann et al.

[11] Patent Number: 5,253,937

[45] Date of Patent: Oct. 19, 1993

[54] METHOD AND APPARATUS FOR DISPERSING OR DISSOLVING PARTICLES OF A PELLETIZED MATERIAL IN A LIQUID

[75] Inventors: David W. Scheimann; Nang T. Bui, both of Aurora, Ill.

[73] Assignee: Nalco Chemical Company, Naperville, Ill.

[21] Appl. No.: 905,722

[22] Filed: Jun. 29, 1992

[51] Int. Cl.[5] ..... B01F 15/02

[52] U.S. Cl. ..... 366/136; 137/268; 366/165; 422/263

[58] Field of Search ..... 366/136, 137, 165; 137/268; 134/93; 422/261, 263

[56] References Cited

U.S. PATENT DOCUMENTS

| | | | |
|---|---|---|---|
| 1,944,836 | 1/1934 | Cowles | 366/165 |
| 2,387,945 | 10/1945 | McDow | 137/268 |
| 2,469,825 | 5/1949 | Hornstein | 366/165 |
| 2,997,373 | 8/1961 | Stephens | 366/137 |
| 3,607,105 | 10/1971 | Reid et al. | 23/267 |
| 4,199,001 | 4/1980 | Kratz | 136/268 |
| 4,235,849 | 11/1980 | Handeland | 422/263 |

OTHER PUBLICATIONS

Fred M. Thomson, *FEEDERS: Smoothing the flow of materials through the plant,* Oct. 30, 1978, pp. 113–123.

*Primary Examiner*—Robert W. Jenkins

*Attorney, Agent, or Firm*—Laff, Whitesel, Conte & Saret

[57] ABSTRACT

A method and an apparatus for dispersing or dissolving a pelletized material in a liquid, in which a pelletized material is placed on a platform in a container having a lower chamber portion, and a stream of liquid is introduced into that lower chamber to produce a vortex of the liquid which washes across the pelletized material, thereby causing it to become dispersed or dissolved into the liquid.

29 Claims, 3 Drawing Sheets

Fig. 1
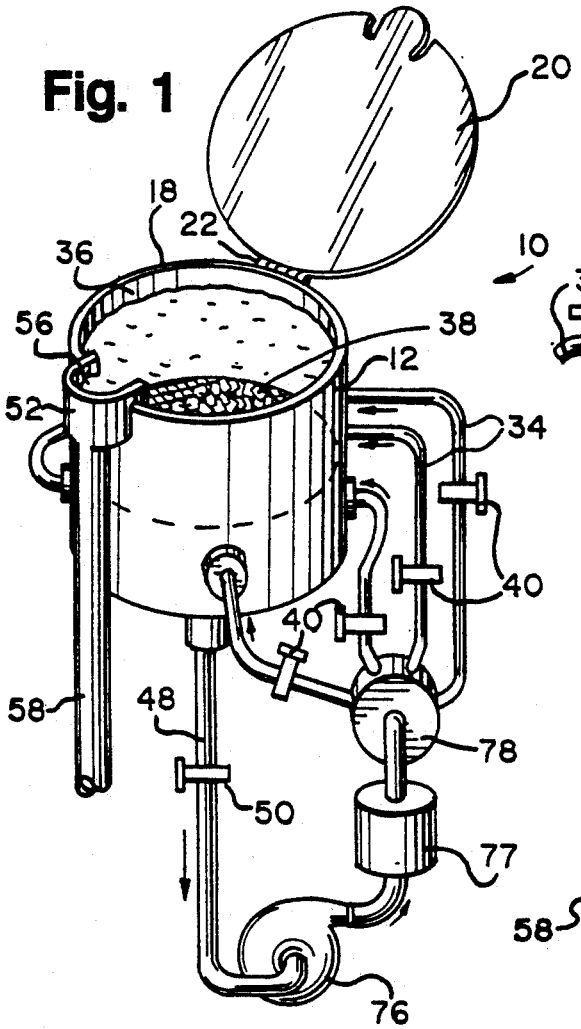
Fig. 2
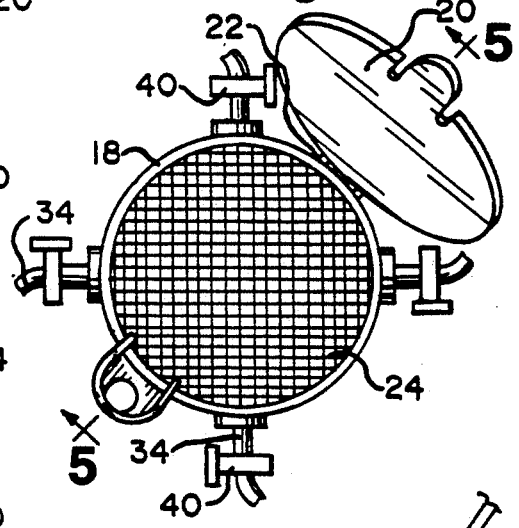
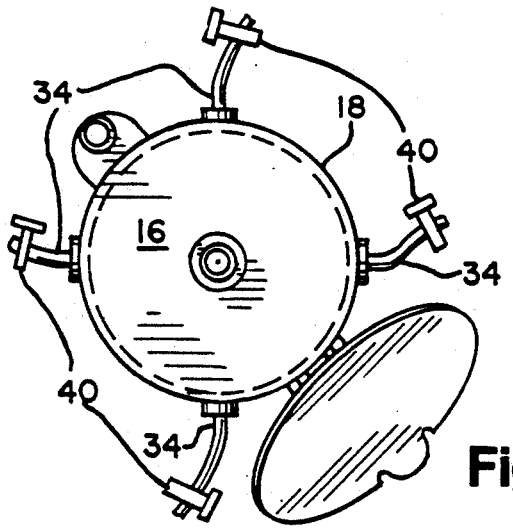
Fig. 3
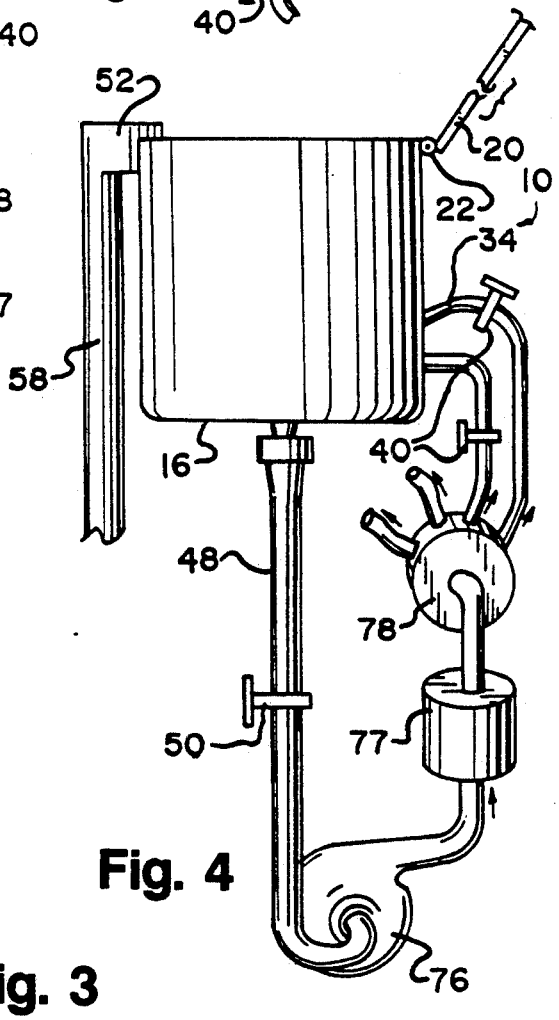
Fig. 4

Fig. 7
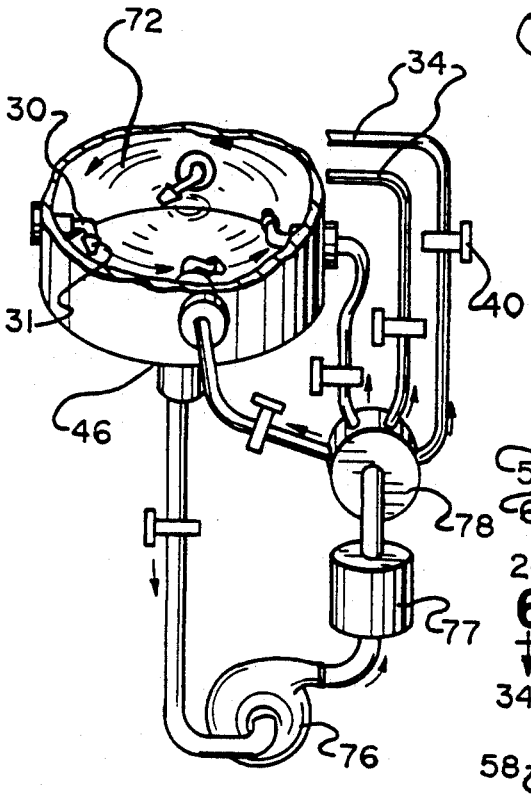
Fig. 6
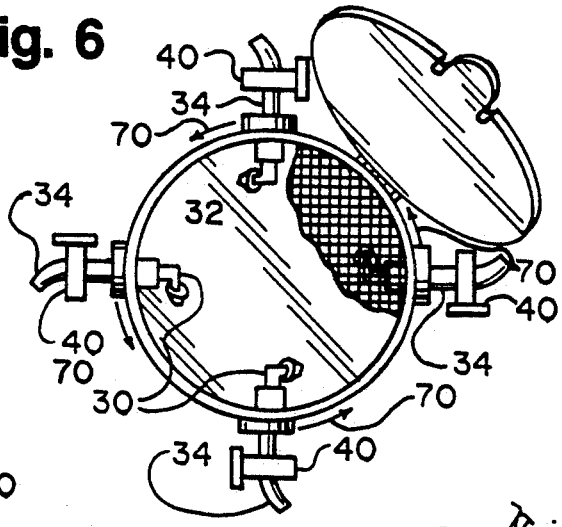
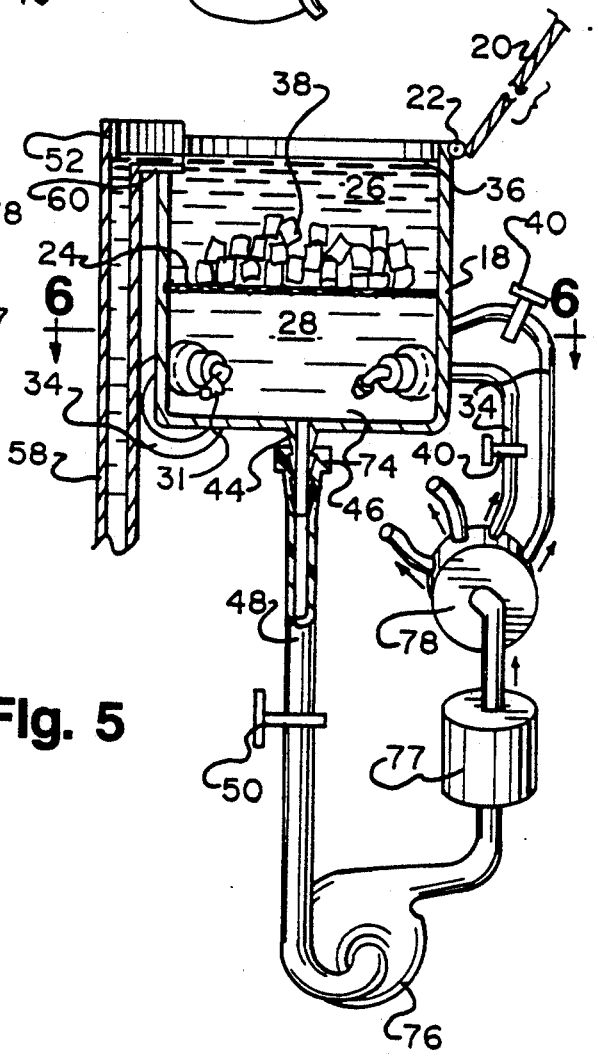
Fig. 5

Fig. 8
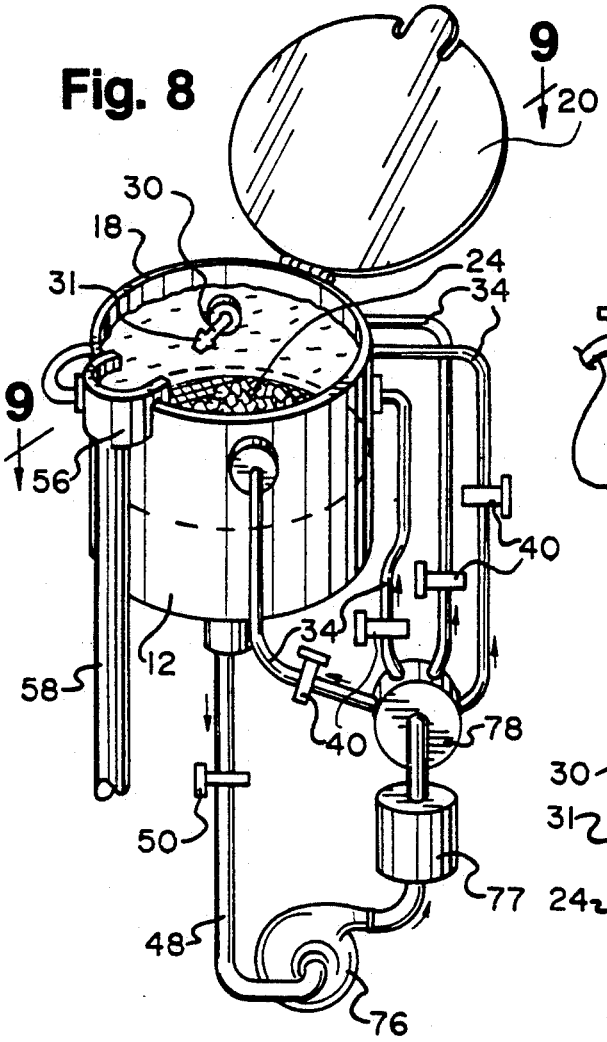
Fig. 10
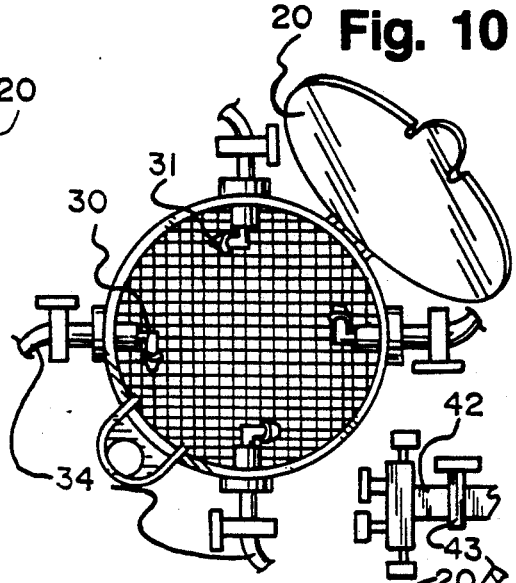
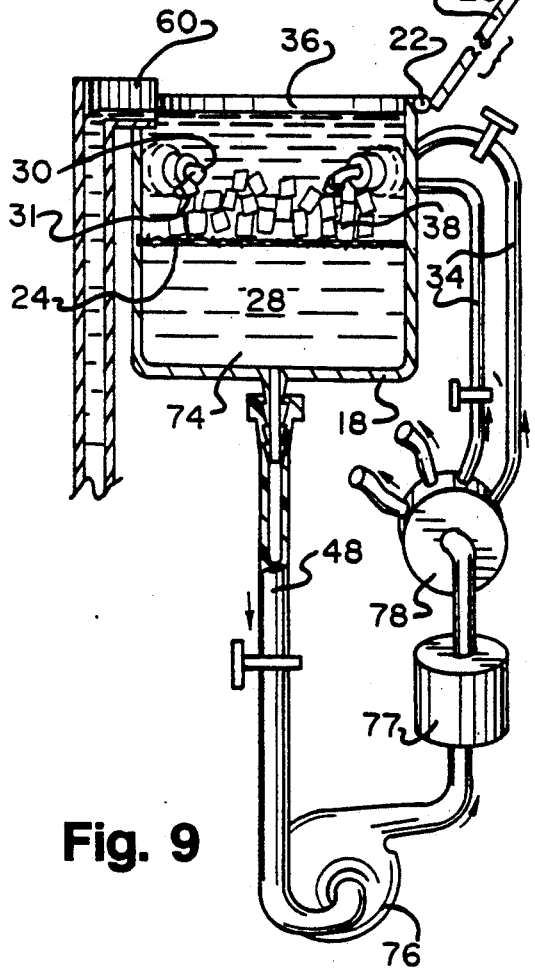
Fig. 9
Fig. 11
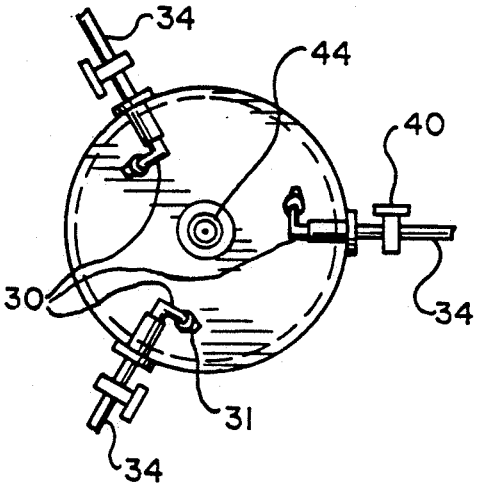

METHOD AND APPARATUS FOR DISPERSING OR DISSOLVING PARTICLES OF A PELLETIZED MATERIAL IN A LIQUID

FIELD OF THE INVENTION

This invention relates generally to techniques for introducing pelletized materials into liquids. More particularly, this invention relates to a method and an apparatus for dispersing or dissolving particles of a pelletized material in a liquid.

BACKGROUND OF THE INVENTION

Chemical treatments are often prepared, transported and used in dry powder or granular form. Typically, such treatments must be dispersed or dissolved in water or other liquids before being used. Unfortunately, when dry powdered or granular chemicals are dispersed or dissolved, they often do not diffuse completely or uniformly throughout the liquid, and may settle in the mixing container and obstruct the supply and return lines. This can result in undesirable variations in concentration, errors in treatment levels and equipment failure.

These, and the other problems inherent in the use of dry powdered or granular chemicals may be avoided or reduced by pressing the dry powdered or granular chemicals into pellets and then immersing the pellets in a liquid to gradually strip away and disperse or dissolve the chemicals. Unfortunately, currently available systems for achieving this end are often large, complex, and expensive and do not produce consistent results.

For example, in one common system, pelletized materials are suspended in a quiescent liquid reservoir to slowly break-up and disperse or dissolve the pellets, producing a mixture which may be used as desired. In other currently available systems, referred to as "pot feeders" and "by-pass feeders", one or more jets or currents of water are directed parallel to the vertical axis of the reservoir, to pass directly into and through the pelletized materials. These systems, unfortunately, are not as efficient as desired to completely dissolve and disperse many pelletized materials.

Accordingly, an object of the present invention is to provide an improved method and apparatus for dispersing or dissolving particles of a pelletized material in a liquid.

Another object of the present invention is to provide a method and an apparatus for accurately controlling the rate at which a pelletized material is dispersed or dissolved in a liquid.

A further object of the present invention is to provide a method and an apparatus for regulating the distribution of a liquid having particles of a pelletized material suspended therein.

Yet another object of the present invention is to provide a highly reliable method and a low maintenance apparatus for dispersing or dissolving particles of a pelletized material in a liquid which, itself, requires no moving parts.

These and other objects and advantages of the invention will become apparent from the following description and drawings.

SUMMARY OF THE INVENTION

The present invention accomplishes the foregoing objects by providing a method and an apparatus for dispersing and dissolving pelletized materials in liquids, in which the pelletized materials are placed in a container, a stream of liquid is introduced to produce a vortex which washes against the pelletized material causing the particles of the pelletized material to become dispersed or dissolved in the liquid, and the resulting dispersion or solution is removed from the container.

In one preferred embodiment of the invention, the apparatus includes a cylindrical container which is used to hold water and a solid pelletized chemical. The container comprises upper and lower chambers separated by a mesh screen or platform to hold the pellets. A plurality of liquid injection ports are arranged to produce a vortex which rises from the lower chamber to wash against the pellets. The injection ports are fed by liquid supply conduits, and the container has a liquid overflow outlet as well as a liquid distribution outlet for draining off the dispersion or solution which is produced by the apparatus.

When operating the invention, the pelletized chemical is placed onto the platform and the container is filled with liquid which enters through the ports. As the liquid enters the container, the force of the water exiting the ports, as directed by the positioning of the ports, cause the liquid to swirl within the container, creating a vortex which washes past the surface of the pelletized material. This swirling action breaks particles away from the surface of the pellets. These freed particles are dispersed or dissolved into the liquid by the moving stream. The resulting mixture is then removed from the container and applied as desired.

In one preferred embodiment, the invention is used with a paint spray booth system as a paint detackifier feeder. In this application, water is forced into a container holding pelletized detackifier which breaks up and disperses throughout the water. The resulting water/detackifier dispersion is then removed from the container and transported to the paint spray booth system. As the water/detackifier mixture is removed, additional water is pumped into the container from the main water reservoir of the paint spray booth continuing the dispersal of the detackifier which is continuously returned to the paint spray booth to react with the paint droplets surrounding them and making the paint nontacky.

A novel feature of the above embodiment of the invention is that the apparatus utilizes the pump of the paint spray booth system (or other chemical treatment system), and therefore, does not itself require any moving parts. Of course, in some applications a dedicated pump may be required. In addition, the system continuously recirculates resulting in a continuous flow of the liquid, a uniform break-up of the pelletized material, and a reliable chemical feed.

The above, as well as other objects and advantages of the invention, will become apparent from the following detailed description in which the reference is made in the accompanying drawings.

BRIEF DESCRIPTION OF THE DRAWINGS

FIG. 1 is a perspective view of a preferred embodiment of the invention, depicting the container of the invention filled with a liquid and a pelletized material.

FIG. 2 is a top plan view of the preferred embodiment of FIG. 1, depicting a reticulated platform inside the container.

FIG. 3 is a bottom plan view of the preferred embodiment of FIG. 1, depicting liquid supply hoses, a distribution tube and an overflow return tube.

FIG. 4 is an elevational view of the preferred embodiment of FIG. 1 of the invention.

FIG. 5 is a cross-section view, taken along line 5—5 of FIG. 2.

FIG. 6 is a cross-section view, taken along line 6—6 of FIG. 5, depicting liquid injection nozzles, a bulkhead fitting and the overflow return tube.

FIG. 7 is a cut-away perspective view of the preferred embodiment of the invention of FIG. 1, depicting the liquid injection nozzles creating a vortex within the container.

FIG. 8 is a perspective view of an alternative embodiment of the invention depicting the liquid supply hoses and liquid injection nozzles located above the reticulated platform.

FIG. 9 is a cross-section view, taken along line 9—9 of FIG. 8.

FIG. 10 is a perspective view of the embodiment of FIG. 8, depicting the liquid supply hoses connected to a main supply hose.

FIG. 11 is a perspective view of an alternative embodiment of the invention, depicting liquid supply hoses having a single liquid supply adjustment valve.

DETAILED DESCRIPTION OF THE INVENTION

While the description below refers to a paint detackifier feeder, the invention is not intended to be limited to that embodiment and should be construed as extending to any application in which a pelletized chemical, in ball, stick, tablet or other shape, is to be dissolved or dispersed in a liquid.

Turning now to FIGS. 1, 2 and 5, the apparatus of the invention 10 includes a container 12 having a generally cylindrical body including a base 16, a continuous cylindrical side 18, and a cover 20 connected to the container 12 by a hinge 22. Container 12 comprises upper and lower chambers 26 and 28 separated by a sieve-like or reticulated platform 24 holding paint detackifier pellets 38. Although it is preferred that the container be cylindrical, as illustrated, other shapes may be used so long as dead zones are avoided by properly positioning the ports (discussed below) to prevent sediment build-up in corners.

As best seen in FIGS. 5-7, four injection ports 30 are mounted within the lower chamber 28 of container 12 by mounting brackets 32 and fed by four corresponding liquid supply hoses 34 mounted near the base 16 of the container 12. Injection ports 30 are fitted with "full stream" or "solid stream" nozzles 31 to focus the liquid stream and interconnected with each other by conduits 34 which are in communication with an external pump which supplies liquid under pressure to the apparatus. In alternate embodiments of the invention, the ports may be simply appropriately-sized orifices. In the illustrated embodiment, container 12 is about 35 inches tall and about 13 inches in diameter, supply hoses 34 have a ½" i.d., nozzles 31 have a ¼" i.d. and the external pump produces between about 20 and 80 p.s.i. These parameters will, of course, be adjusted on an application-by-application basis to satisfy the unique requirements of any given application.

As seen in FIG. 2, liquid supply hoses 34 include adjustment valves 40 which allow the user of the apparatus to regulate the amount of water 36 being supplied to apparatus 10. In alternative embodiments of the invention, conduits 34 may branch off central conduit 42, which includes a main adjustment valve 43 (FIG. 10), or, conduits 34 may only include one adjustment valve 40 on a single hose (FIG. 11).

FIGS. 3, 5 and 7 illustrate a main distribution outlet 44 interconnecting the container 12 and the paint spray booth's pumping system 76. The distribution outlet 44 comprises a bulkhead fitting 46 and a distribution hose 48 having a distribution adjustment valve 50. The distribution hose 48 is interconnected to pump 76 which supplies the water/detackifier to the paint spray booth 77. The distribution adjustment valve 50 allows the user to regulate the amount of water/detackifier mixture which is being drawn by pump 76 from apparatus 10 for use in the paint spray booth. Also, coordinated adjustment of valves 40 and 50 allows the user to regulate the concentration of detackifier 38 within the water, as discussed below.

Apparatus 10 further includes a liquid overflow outlet 52 mounted to side 18 of container 12 near the upper portion of chamber 26. Outlet 52, which is interconnected between the container 12 and the detackifier water reservoir of the paint spray booth system (not shown), serves to relieve overflow from container 12. Overflow outlet 52 includes an overflow trough 56 and a overflow return hose 58 which extends downwardly from the base 60 of the trough 56, externally along side 18 of the container 12.

When apparatus 10 is activated, water 36 from the detackifier water reservoir of the paint spray booth is pumped through the liquid supply hoses and into container 12 through liquid injection ports 30. Nozzles 31 of injection ports 30 are positioned so that the water is injected along line 70 which is tangential to the inner surface of the container. Additionally, the ports are positioned at an angle of about 45 degrees below the horizontal so that the water streams strike base 15 of container 12. This angle may be increased toward the vertically downward position or decreased toward the horizontal, so long as the parameters of flow rate, number and positioning of ports, etc. can be adjusted to prevent the formation of dead zones without water movement at the bottom of the container which would otherwise permit undesirable sediment build-up.

The positioning of nozzles 31 creates a vortex of water 36 within the container 12, which washes over the detackifier pellets 38 resting on platform 24 in container 12 (FIG. 7), causing them to disintegrate and dissolve or disperse into the water either immediately or as the released particles 74 continue to be buffeted by the vortex.

The resulting water/detackifier mixture then drains from the container through bulkhead fitting 46 of the liquid distribution outlet 44 and into liquid distribution hose 48, where it is carried away to the paint spray booth's pumping systems. There the mixture is pumped into a cascade of water where the detackifier reacts with the paint by surrounding the free paint particles, facilitating removal of the paint from the system. At least a portion of the detackified paint may then be removed from the system. In any event, a portion of the pressurized flow to the paint spray booth is drawn off as shown schematically at 78 and returned to container 12 by way of liquid supply hoses 34 the entire process.

Liquid adjustment valves 40 on the liquid supply hoses 34 may be adjusted to regulate the rate of flow of the water into container 12. This will increase or decrease the force of vortex 72, thereby increasing or decreasing the rate at which the pellets disintegrate and the detackifier particles 74 are dissolved or dispersed into water 36, and enabling the level or concentration of detackifier in the system to be adjusted as desired.

Finally, the volume of water being supplied to the container may be greater than the volume being drawn from the container through the distribution outlet. When this is the case, the excess will be removed from the container 12 through overflow outlet 52. This excess spills over into trough 56 and is carried away from container 12 to the water reservoir of the paint spray booth (not shown), where it is once again pumped back into the container via the liquid supply hoses 34. Additionally, overflow outlet 52 relieves overflow if the distribution outlet becomes obstructed by the pelletized material or any other substance.

As seen in FIGS. 8 and 9, in an alternate embodiment of the invention, liquid injection ports 30 and liquid supply hoses 34 may be located in upper chamber 26 of the container 12. In this embodiment, ports 30 are angled about 70 degrees below the horizontal, thus creating a slower moving vortex than in the preferred embodiment. In other embodiments of the invention, the number of ports, as well as the angle of incidence, may be increased or decreased (to as few as one), thereby creating a vortex which may be shallower and having a lesser agitation of fluid, or deeper with greater agitation of fluid. In yet another embodiment of the invention, at least two sets of nozzles are provided, one in the container's upper chamber and the other in the container's lower chamber.

While the invention has been described in relation to preferred embodiments thereof, those skilled in the art may develop a wide variation of structural details without departing from the principles of the invention. Accordingly, the appended claims are to be construed to cover all equivalents falling within the scope and spirit of the invention.

The invention claimed is:

1. A method for dispersing or dissolving a pelletized material in a liquid comprising the steps of:

A) providing a container having a lower chamber portion and a platform positioned above the lower chamber portion;

B) placing the pelletized material on the platform;

C) introducing a stream of liquid into the container through at least one port to produce a vortex which washes over the pelletized material and releases particles which are then dispersed or dissolved in the liquid, said port being positioned at an angle below the horizontal so that the water stream strikes the base of the container; and D) removing the resulting dispersion or solution.

2. The method of claim 1 wherein the container is cylindrical.

3. The method of claim 1 in which the platform is reticulated.

4. The method of claim 1 in which the port is fitted with a nozzle.

5. The method of claim 1 in which the container is cylindrical and the port is positioned to direct the water generally tangentially to the inner surface of the container.

6. The method of claim 1 in which the port is positioned at an angle of 45° below the horizontal.

7. The method of claim 1, in which the port is located above the platform.

8. The method of claim 7, in which the port is angled below the horizontal to direct the water stream against the bottom of the container.

9. The method of claim 8, in which the port is angled about 70° below the horizontal.

10. The method of claim 1, wherein there are at least two ports and in which at least one port is positioned above the platform and at least one port is positioned below the platform.

11. The method of claim 1, in which the resulting dispersion or solution is removed from near the base of the container.

12. The method of claim 1 in which excess resulting dispersion or solution is removed as an overflow from the top of the container.

13. The method of claim 1, in which the rate of flow of water into the container is regulated to increase or decrease the rate at which the pellets disintegrate and the particles are dissolved or dispersed into the water.

14. An apparatus for dispersing or dissolving a pelletized material in a liquid comprising:

a container for holding the liquid;

means for suspending pelletized material within the container;

means for producing a vortex of liquid to contact pelletized material suspended within the container, thereby causing the particles of the pelletized materials to become dispersed or dissolved in the liquid, said vortex producing means including at least one port angled below the horizontal for directing a stream of liquid against the bottom of the container; and means for removing liquid containing the dissolved or dispersed particles.

15. The apparatus of claim 14 wherein the container is cylindrical.

16. The apparatus of claim 14 in which the suspending means is reticulated a platform.

17. The apparatus of claim 14 in which the vortex producing means comprises more than one port for introducing the stream of liquid into the container.

18. The apparatus of claim 14 in which the port is fitted with a nozzle.

19. The apparatus of claim 14 in which the port is angled generally along the inner surface of the container.

20. The apparatus of claim 14 in which the container is cylindrical and the port is angled to direct the water generally tangentially to the inner surface of the container.

21. The apparatus of claim 14 in which the port is positioned at an angle less than 90° below the horizontal.

22. The apparatus of claim 14, in which the port is located below the suspending means.

23. The apparatus of claim 14, in which the port is located above the suspending means.

24. The apparatus of claim 14, in which the vortex producing means comprises at least one port located above the suspending means and at least one port located below the suspending means.

25. The apparatus of claim 24, in which the ports are angled below the horizontal to direct the water stream against the bottom of the container.

26. The apparatus of claim 14, in which the port is angled about 70° below the horizontal.

27. The apparatus of claim 14 in which the port is positioned at an angle of 45° below the horizontal.

28. The apparatus of claim 14, in which the means for removing the resulting dispersion or solution is located near the base of the container.

29. The apparatus of claim 14, including means for removing excess resulting dispersion or solution from near the top of the container.

* * * * *